US005447047A

United States Patent [19]

Lin

[11] Patent Number: 5,447,047

[45] Date of Patent: Sep. 5, 1995

[54] DEAD BOLT OF A DOOR LOCK

[75] Inventor: Jui-Chang Lin, Kaohsiung, Taiwan

[73] Assignee: Taiwan Fu Hsing Industrial Co., Ltd., Hsien, Taiwan

[21] Appl. No.: 92,072

[22] Filed: Jul. 16, 1993

Related U.S. Application Data

[63] Continuation-in-part of Ser. No. 949,163, Sep. 23, 1992, abandoned.

[51] Int. Cl.[6] ..... E05B 47/06

[52] U.S. Cl. ..... 70/218; 70/277; 70/472; 70/276

[58] Field of Search ..... 70/279, 283, 277, 278, 70/224, 472, 218–220, 276, 413

[56] References Cited

U.S. PATENT DOCUMENTS

| | | | |
|---|---|---|---|
| 3,018,652 | 1/1962 | Dubonnet | 292/DIG. 37 |
| 4,073,527 | 2/1978 | Schlage | 292/DIG. 27 |
| 4,736,970 | 4/1988 | McGourty et al. | 70/283 |
| 4,956,984 | 9/1990 | Chi-Cheng | 70/279 |
| 5,010,752 | 4/1991 | Lin | 70/277 |
| 5,040,391 | 8/1991 | Lin | 70/279 |

FOREIGN PATENT DOCUMENTS

| | | | |
|---|---|---|---|
| 2528712 | 1/1978 | Germany | 70/422 |

*Primary Examiner*—Peter M. Cuomo
*Assistant Examiner*—Darnell M. Boucher
*Attorney, Agent, or Firm*—Jacobson, Price, Holman & Stern

[57] ABSTRACT

A dead bolt includes an outer lever and an inner lever, a coil disposed in the outer lever, a rod slidably engaged in the coil and having two extensions, a shaft coupled between the two levers, a disc engaged on the shaft and having two grooves for engaging with the extensions of the rod, the extensions of the rod are biased away from the grooves of the disc such that the shaft can not be rotated by the outer lever, and the rod is caused to move toward the disc when the coil is energized such that the extensions of the rod are caused to engage with the grooves of the disc and such that the shaft can be rotated by the outer lever.

4 Claims, 6 Drawing Sheets

1
2
12
10
11
351
53
32
56
57
52
521
55
552
41
21
43
33
34
35
54
42
58
39
13
37
51
30
3
4

DEAD BOLT OF A DOOR LOCK

This is a Continuation-In-Part application of Ser. No. 07/949,163 filed Sep. 23, 1992, now abandoned.

BACKGROUND OF THE INVENTION (a) Field of the Invention

The present invention relates to a dead bolt, and more particularly to a dead bolt of a door lock.

(b) Description of the Prior Art

Various kinds of dead bolts have been developed, however, most of them include a complicated configuration which greatly increases the manufacturing cost thereof.

The present invention has arisen to provide a novel dead bolt.

SUMMARY OF THE INVENTION

The primary objective of the present invention is to provide a dead bolt which has an electric lock controlled by an electric circuit and a key and has wider adaptability.

In accordance with one aspect of the present invention, a dead bolt comprises an outer housing including an opening formed in a lower portion thereof, a decoding means disposed on an upper portion of the outer housing, an outer lever including a stub rotatably engaged in the opening of the outer housing, an inner housing, an inner lever rotatably engaged in the inner housing, an aperture formed in the stub, a lock engaged in the aperture of the stub, a first disc secured to the lock and including a projection formed thereon, a second disc slidably disposed in the stub and including a depression formed therein for engaging with the projection of the first disc, means for biasing the second disc toward the first disc, a coil disposed in the outer housing and connected to and controlled by the decoding means, a rod slidably engaged in the coil and including at least one extension extended radially outward therefrom, a shaft having a first end engaged with the inner lever and rotated in concert with the inner lever, a third disc engaged on the shaft and rotated in concert with the shaft, the third disc including at least one groove for engaging with the extension of the rod, the extension of the rod being biased away from the third disc such that the shaft can not be rotated by the outer lever, and the rod being caused to move toward the third disc when the coil is energized such that the extension of the rod is caused to engage with the groove of the third disc and such that the shaft can be rotated by the outer lever.

Further objectives and advantages of the present invention will become apparent from a careful reading of the detailed description provided hereinbelow, with appropriate reference to the accompanying drawings.

DETAILED DESCRIPTION OF THE INVENTION

Figure 1A:
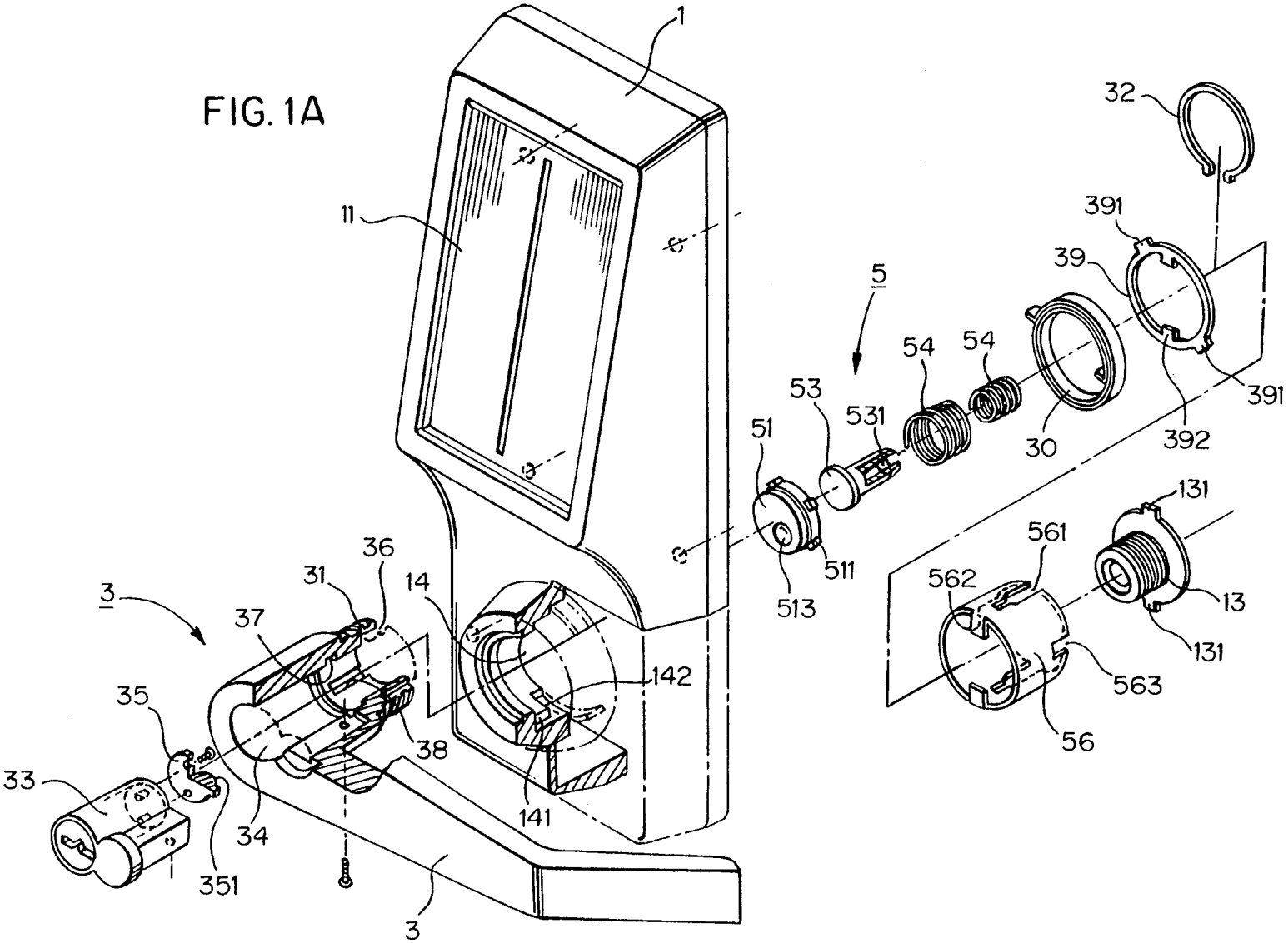
FIGS. 1A and 1B are exploded views illustrating the door lock in accordance with the present invention.
Figure 1B:
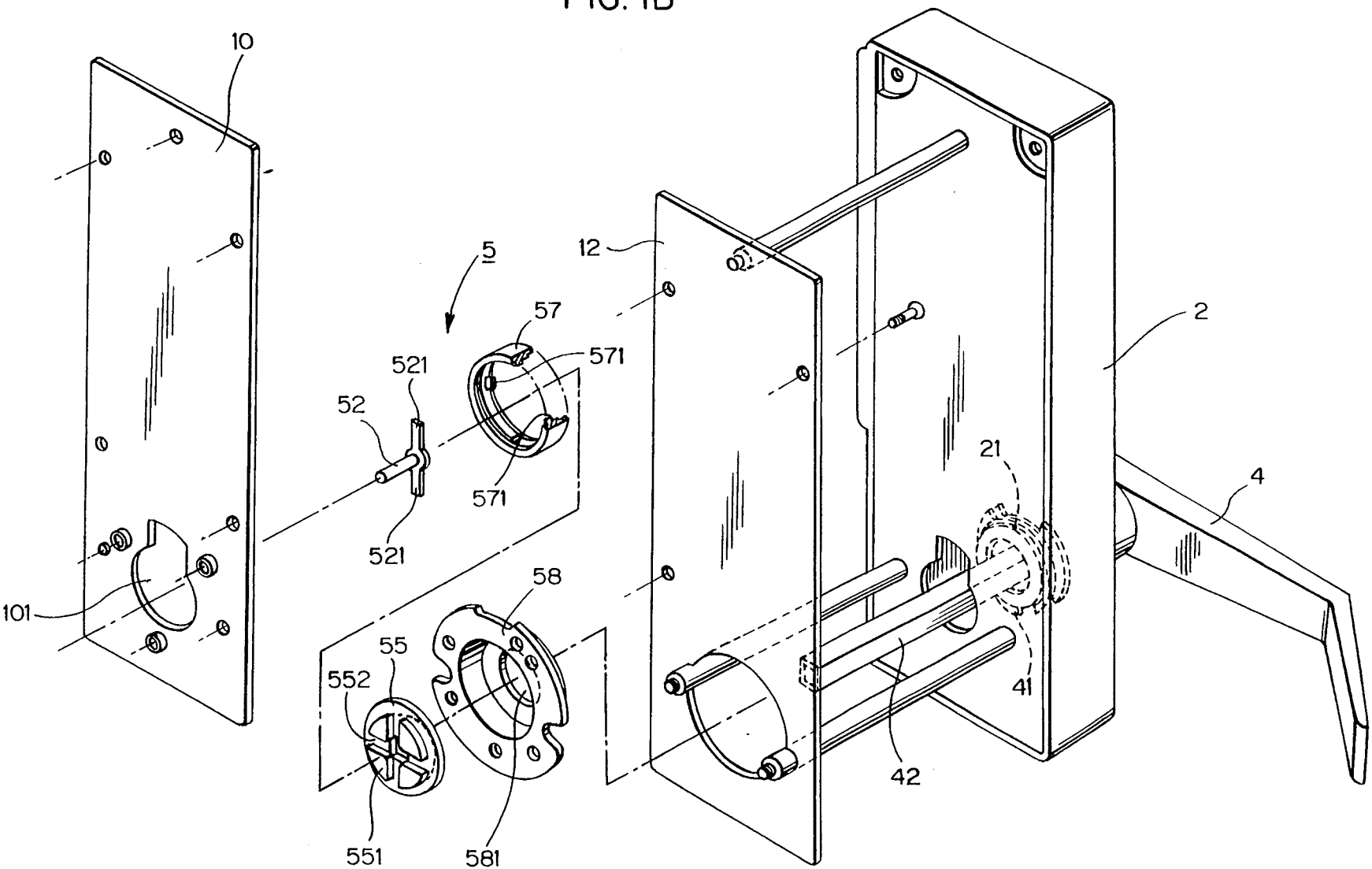
Figure 2:
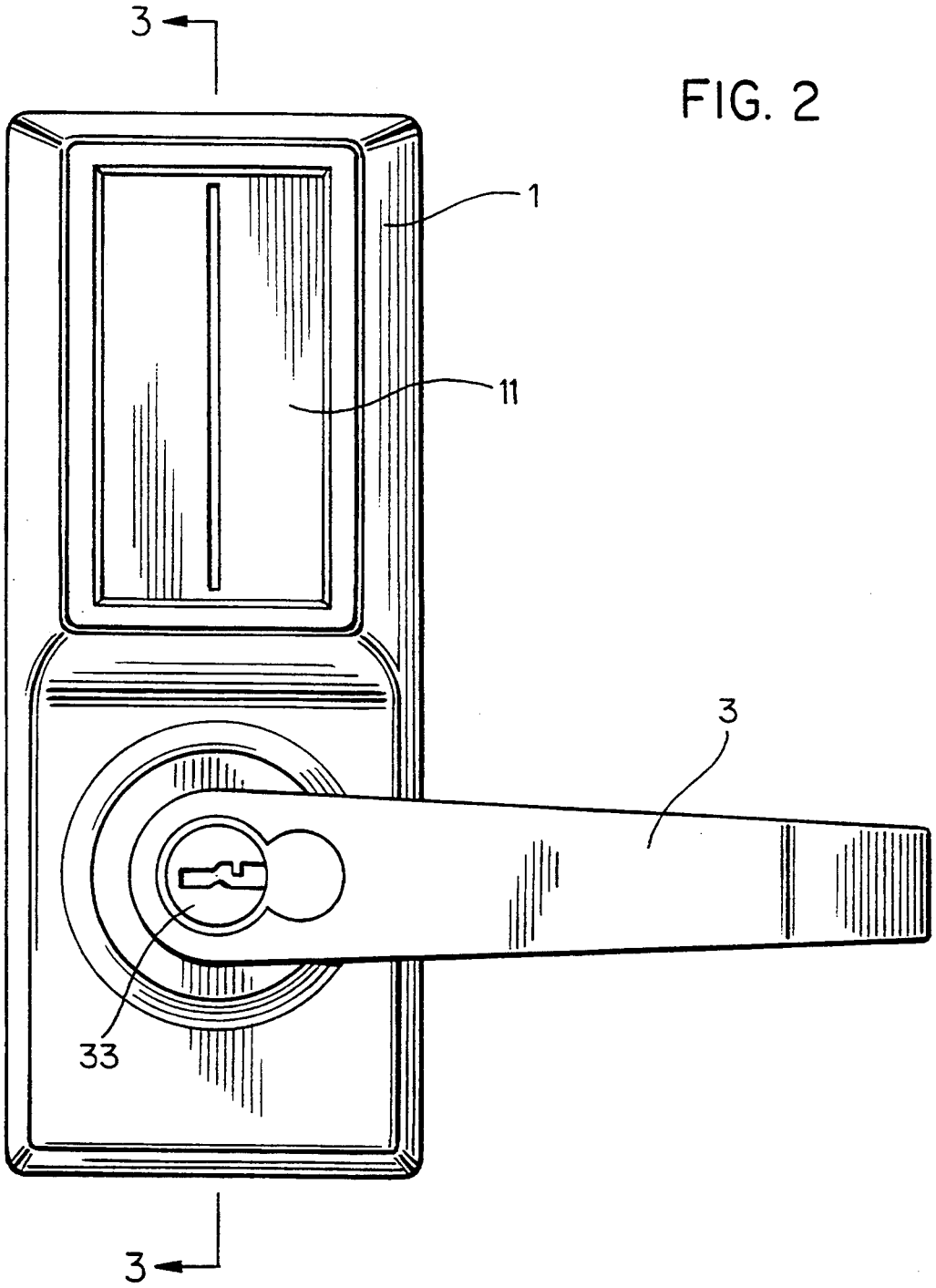
FIG. 2 is a front view of the door lock.
Figure 3:
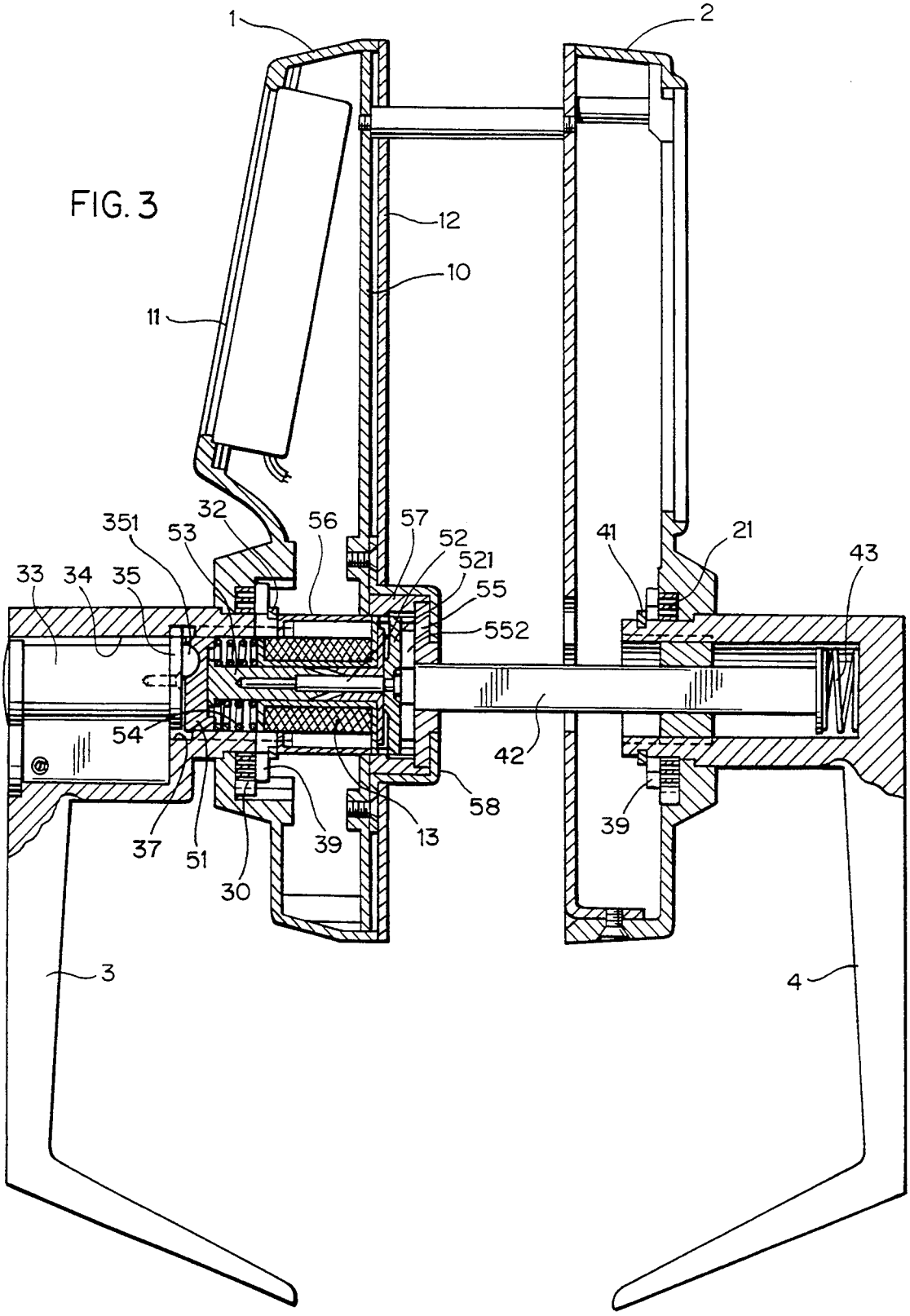
FIG. 3 is a cross sectional view taken along lines 3—3 of FIG. 2.

Referring to the drawings and initially to FIGS. 1 to 3, a dead bolt of a door lock in accordance with the present invention comprises generally an outer housing 1 having a board 10 disposed in the inner portion thereof, an inner housing 2, an outer lever 3, and inner lever 4 and parts or elements 5 disposed in the outer housing 1 and enclosed by the board 10; and a decoding means 11 disposed in front of the outer housing 1 and cooperated with a magnetic card, finger prints or a key board in order to energize a coil 13 so as to unlock the dead bolt, which will be described in further details hereinafter. It is preferable that a water-proof cover 12 is secured to the outer housing 1 and is provided to cover and to enclose the parts within the board 10.

The outer housing 1 includes an opening 14 formed in the lower portion, an annular groove 141 formed in the opening 14 for receiving the coil spring 30, a plurality of notches 142 formed therein for engaging with the protrusions 391 of the ring 39, the ring 39 having two projections 392 extended radially inward, the inner lever 4 includes a stub rotatably engaged in the lower portion thereof, a clamping ring 41 engaged on the stub so as to limit the inner lever 4 for rotational movement only, a spring 21 engaged between the inner housing 2 and the inner lever 4 for recovering the inner lever 4, the inner lever 4 includes a shaft 42 engaged therein, a spring 43 is provided to bias the shaft 42 outward of the inner lever such that the free end of the shaft 42 is engaged with the board 10 of the outer housing 1.

The outer lever 3 includes a stub extended into the opening 14 of the outer housing 1 and having an annular groove 31 formed therein for engagement with a clamping ring 32 so that the outer lever 3 is limited to rotation movement only. The ring 39 is engaged on the stub of the outer lever 3, the spring 30 has one end engaged with the protrusion 391 and has the other end engaged with another protrusion formed in the outer housing 1 so as to bias the outer lever 3. The stub of the outer lever includes an aperture 34 formed therein for receiving a lock 33, a disc 35 is fixed to the rear end of the lock 33 and includes a projection 351 formed thereon.

The elements 5 include a disc 51 having a depression 513 formed therein for engaging with the projection 351 of the disc 35 and having ears 511 extended radially outward therefrom for engaging with the notches 38 of the outer lever 3 such that the disc 51 may move longitudinally inwards of the stub of the outer lever 3 to engage with the disc 35 of the lock 33, a spring 54 is provided to bias the disc 51 toward the disc 35, a core 53 is slidably disposed in a coil 13 and includes a bore 531 formed therein, another spring 54 is provided to bias the core 53 toward the disc 51, a rod 52 (FIG. 1B) has one end fixed in the bore 531 of the core 53 and has two extensions 521 extended therefrom for engaging with the grooves 552 of a disc 55, the disc 55 includes a square hole 551 engaged on the shaft 42, the extensions 521 of the rod 52 are engaged in the slots 561 of a sleeve 56, the sleeve 56 includes two ears 562 for engaging with the notches 36 of the outer lever 3, and includes two notches 563 formed therein, a cap 57 engaged in a casing 58 for positioning the disc 55 and including two protrusions 571 for engaging with the notches 563 of the sleeve 56, the casing 58 is fixed to the board 10 and includes an opening 581 formed therein from rotatably receiving an extension (not shown) of the disc 55, the coil 13 includes a disc secured thereto and having two projections 131 formed thereon for engaging with the slots 561 of the sleeve 56, the sleeve 56 is rotatably engaged in the opening 101 formed in the board 10.

In operation, as shown in FIG. 3, normally, the shaft 42 can be rotated by the inner lever 4, however, at this moment, the extensions 521 of the rod 52 are disengaged from the grooves 552 of the disc 55 such that the shaft 42 can not be rotated by the outer lever 3, whereby, the door with such a dead bolt can be opened from inside of the door and can not be opened from outside of the door.

Figure 4:
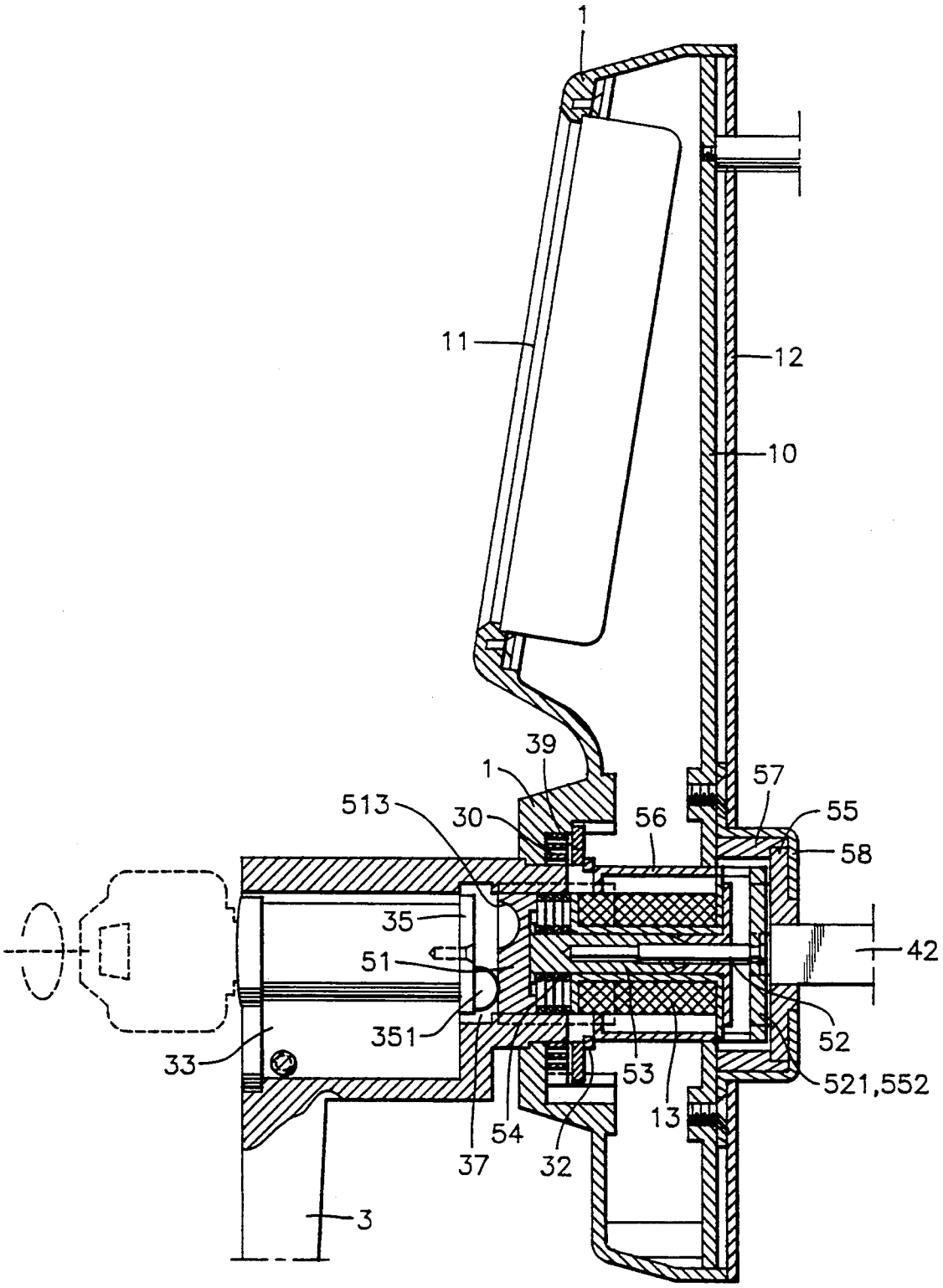
FIGS. 4 and 5 are cross sectional views similar to FIG. 3 for illustrating the operations of the door lock.

Referring next to FIG. 4, when a key is engaged into the lock 33 and is rotated for 180 degrees, the disc 35 is also rotated for 180 degrees such that projection 351 of the disc 35 is disengaged from the depression 513 of the disc 51 such that the disc 51 is caused to move toward the rod 52 and such that the extensions 521 of the rod 52 are caused to engaged with the grooves 552 of the disc 55, whereby, the shaft 42 can be rotated by the outer lever 3. However, when the key lock 33 is rotated backwards, the outer lever 3 is recovered by the spring 30, the projection 351 of the disc 35 is engaged in the depression 513 of the disc 51 again such that the extensions 521 of the rod 52 are disengaged from the grooves 552 of the disc 55 again, whereby, the shaft 42 can not be rotated again.

Figure 5:
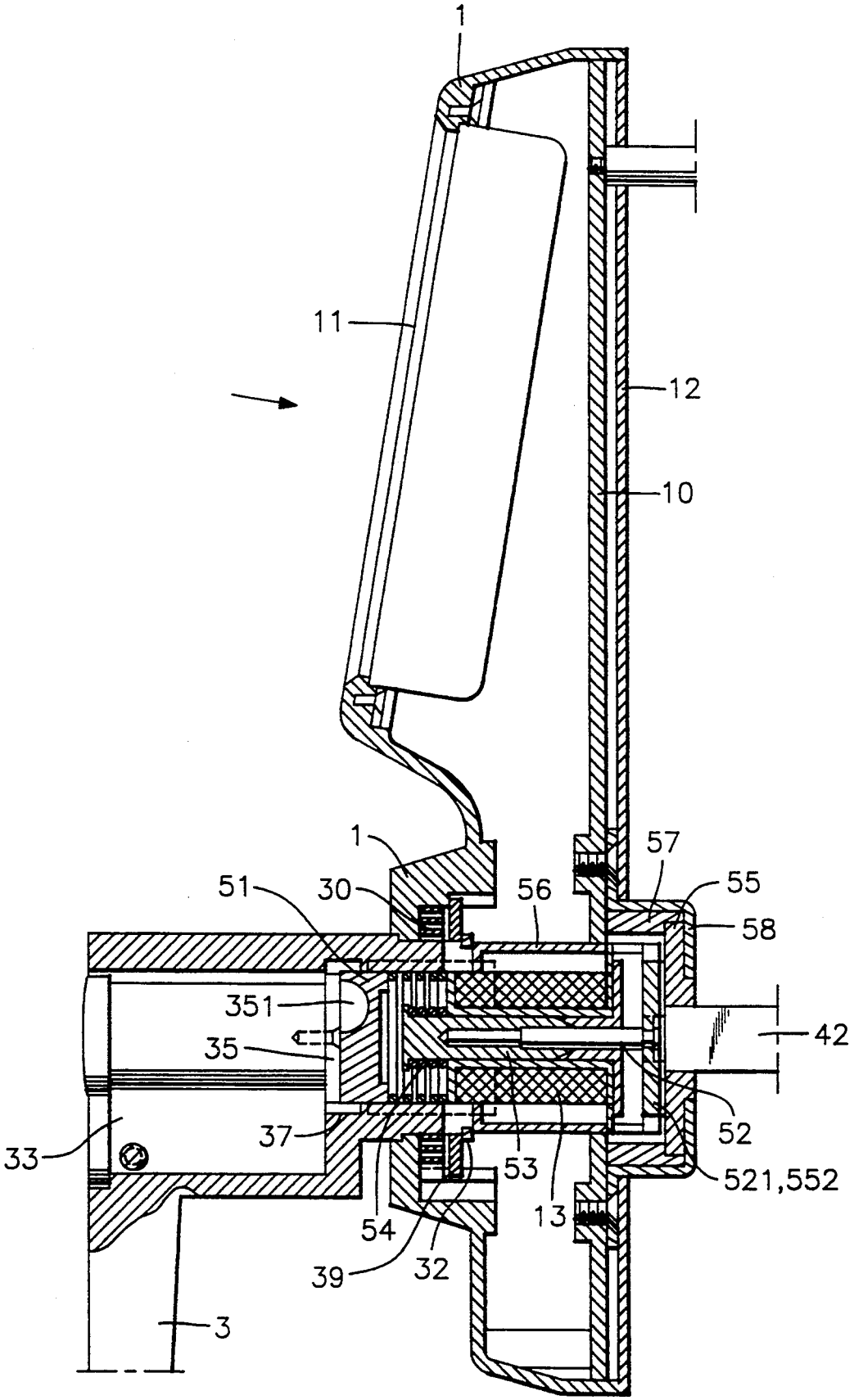

Referring next to FIG. 5, when a decoding means 11 is decoded, the coil 13 is energized such that the rod 52 is caused to move rightward and such that the extensions 521 of the rod 52 are caused to engage with the grooves 552 of the disc 55, whereby, the shaft 42 can be rotated and the door can be opened. It is to be noted that the coil 13 will be energized for a predetermined period of time such that the rod 52 and the disc 55 are biased away from each other when the coil 13 is not energized.

Accordingly, the dead bolt in accordance with the present invention can be opened either by a decoding means or by a key.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A dead bolt comprising an outer housing including an opening formed in a lower portion thereof, a decoding means disposed on an upper portion of said outer housing, an outer lever including a stub rotatably engaged in said opening of said outer housing, an inner housing, an inner lever rotatably engaged in said inner housing, an aperture formed in said stub, a lock engaged in said aperture of said stub, a first disc secured to said lock and including a projection formed thereon, a second disc slidably disposed in said stub and including a depression formed therein for engaging with said projection of said first disc, means for biasing said second disc toward said first disc, a coil disposed in said outer housing and connected to and controlled by said decoding means, a rod slidably engaged in said coil and including at least one extension extended radially outward therefrom, a shaft having a first end engaged with said inner lever and rotated in concert with said inner lever, a third disc engaged on said shaft and rotated in concert with said shaft, said third disc including at least one groove for engaging with said extension of said rod, said extension of said rod being biased away from said third disc such that said shaft can not be rotated by said outer lever, and said rod being caused to move toward said third disc when said coil is energized such that said extension of said rod is caused to engage with said groove of said third disc and such that said shaft can be rotated by said outer lever.

2. The dead bolt according to claim 1 further comprising:

a core slidably disposed in said coil, said core having a bore formed therein.

3. The dead bolt according to claim 2 wherein the core is biased towards the second disc.

4. The dead bolt according to claim 2 wherein the rod has one end which is fixed within the bore.

* * * * *